US011202505B2

(12) United States Patent
Kampl

(10) Patent No.: US 11,202,505 B2
(45) Date of Patent: Dec. 21, 2021

(54) DRAWER ASSEMBLY

(71) Applicant: Julius Blum GmbH, Hoechst (AT)

(72) Inventor: Markus Kampl, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/885,731

(22) Filed: May 28, 2020

(65) Prior Publication Data

US 2020/0288865 A1 Sep. 17, 2020

Related U.S. Application Data

(63) Continuation of application No. PCT/AT2018/060299, filed on Dec. 13, 2018.

(30) Foreign Application Priority Data

Dec. 21, 2017 (AT) ..... A 51063/2017

(51) Int. Cl.
*A47B 88/95* (2017.01)
*A47B 88/90* (2017.01)
(Continued)

(52) U.S. Cl.
CPC ..... *A47B 88/95* (2017.01); *A47B 88/941* (2017.01); *A47B 88/40* (2017.01);
(Continued)

(58) Field of Classification Search
CPC ..... A47B 88/95; A47B 88/941; A47B 88/40; A47B 2230/07; A47B 2088/951;
(Continued)

(56) References Cited

U.S. PATENT DOCUMENTS 3,773,399 A * 11/1973 Sulcek ..... A47B 96/206 312/204
4,108,520 A 8/1978 Litchfield
(Continued)

FOREIGN PATENT DOCUMENTS

CN 103167813 6/2013
CN 103763986 4/2014
(Continued)

OTHER PUBLICATIONS

International Search Report dated Feb. 14, 2019 in International (PCT) Application No. PCT/AT2018/060299 with English-language translation.
(Continued)

*Primary Examiner* — Hanh V Tran
(74) *Attorney, Agent, or Firm* — Wenderoth, Lind & Ponack, L.L.P.

(57) ABSTRACT

A drawer arrangement includes a drawer sidewall having a locking device including a locking lever pre-stressed by a spring, and a wall element to be transversely connected to the drawer sidewall. The wall element, in a connected condition with the drawer sidewall, includes a fastening surface facing towards the drawer sidewall, and a bearing surface facing away from the fastening surface. A furniture fitting separate from the wall element connects the wall element to the drawer sidewall, and the furniture fitting is to be releasably locked to the locking lever of the locking device of the drawer sidewall. The furniture fitting, when the wall element is connected with the drawer sidewall, bears at least partially against the bearing surface of the wall element so that the wall element is held on the drawer sidewall by the locking of the furniture fitting with the locking device of the drawer sidewall.

25 Claims, 5 Drawing Sheets

(51) Int. Cl.
*A47B 88/40* (2017.01)
*A47B 96/20* (2006.01)

(52) U.S. Cl.
CPC ... *A47B 2088/954* (2017.01); *A47B 2088/955* (2017.01); *A47B 2096/207* (2013.01); *A47B 2230/07* (2013.01)

(58) Field of Classification Search
CPC ..... A47B 88/956; A47B 88/944; A47B 2088/954; A47B 2096/207
See application file for complete search history.

(56) References Cited

U.S. PATENT DOCUMENTS

| | | | | |
|---|---|---|---|---|
| 4,832,420 | A | 5/1989 | Rock et al. | |
| 4,846,538 | A * | 7/1989 | Rock | F16B 5/0614 312/263 |
| 8,931,862 | B2 | 1/2015 | Grimm | |
| 9,185,981 | B1 * | 11/2015 | Kane | A47B 77/02 |
| 9,943,167 | B2 * | 4/2018 | Lucas | A47B 96/00 |
| 2009/0289537 | A1 * | 11/2009 | Cabal Velarde | A47B 88/956 312/408 |
| 2010/0283359 | A1 * | 11/2010 | Hottmann | A47B 88/40 312/204 |
| 2014/0184047 | A1 * | 7/2014 | Grimm | A47B 88/944 312/319.1 |
| 2014/0225493 | A1 * | 8/2014 | Gasser | A47B 88/40 312/265.5 |
| 2014/0252936 | A1 * | 9/2014 | Holzapfel | A47B 88/956 312/348.4 |
| 2015/0173509 | A1 * | 6/2015 | Picchio | A47B 47/025 312/265.5 |
| 2016/0278521 | A1 * | 9/2016 | Chen | A47B 88/42 |
| 2018/0168343 | A1 * | 6/2018 | Held | A47B 88/95 |

FOREIGN PATENT DOCUMENTS

| | | | | |
|---|---|---|---|---|
| CN | 105324054 | | 2/2016 | |
| CN | 205457295 | | 8/2016 | |
| DE | 3801103 | | 8/1988 | |
| DE | 102006033360 | | 1/2008 | |
| DE | 20 2010 007 427 | | 10/2011 | |
| DE | 202015100068 | U1 * | 4/2016 | A47B 88/944 |
| EP | 0 740 917 | | 11/1998 | |
| EP | 2486824 | A1 * | 8/2012 | A47B 95/00 |
| JP | 2014-525292 | | 9/2014 | |
| WO | 2007/137311 | | 12/2007 | |
| WO | WO-2009/111807 | A2 * | 9/2009 | |
| WO | 2013/029066 | | 3/2013 | |
| WO | 2013/067551 | | 5/2013 | |
| WO | 2014/198819 | | 12/2014 | |

OTHER PUBLICATIONS

Chinese Search Report dated Mar. 26, 2021 in corresponding Chinese Patent Application No. 201880081716.5.

* cited by examiner

DRAWER ASSEMBLY

BACKGROUND OF THE INVENTION

The present invention relates to a drawer arrangement including a drawer sidewall having a locking device, the locking device of the drawer sidewall including a locking lever pre-stressed by at least one spring. A wall element is transversely connected to the drawer sidewall, and the wall element, in a connected condition with the drawer sidewall, includes a fastening surface facing towards the drawer sidewall, and a bearing surface facing away from the fastening surface. The drawer arrangement further includes at least one furniture fitting separate from the wall element for connecting the wall element to the drawer sidewall, wherein the at least one furniture fitting is configured to be releasably locked to the locking lever of the locking device of the drawer sidewall.

Furthermore, the invention concerns a drawer wall comprising at least one of such a drawer arrangement, and further a drawer comprising such a drawer arrangement or at least one drawer wall of the aforementioned type.

Furthermore, the invention relates to a method for connecting a wall element to a drawer sidewall of a drawer arrangement of the described type.

Drawers with wall elements configured to be transversely connected to one another are disclosed in WO 2013/067551 A1, U.S. Pat. No. 4,108,520 A and in DE 20 2010 007 427 U1.

Such drawer arrangements are widely known (for example from EP 0 740 917 B1 to the present applicant) and serve for fixing a front panel to drawer sidewalls. For this purpose, bores are firstly drilled into the rear side of the front panel. Subsequently, the furniture fittings are fixed to the front panel by tightening screws into the pre-drilled holes. Alternatively, the furniture fittings can be fixed to the front panel by dowels, and the dowels are configured to be expandable within the bores of the front panel. Each of the drawer sidewalls includes a locking device having a movably mounted locking lever which is pre-stressed by a spring.

When the front panel is mounted, the furniture fittings pre-mounted to the front panel are introduced into the front faces of the two drawer sidewalls, and each of the furniture fittings are moved into a notch of the locking lever. In that way, the locking levers of the drawer sidewalls can be released, so that the furniture fittings are retracted into the drawer sidewalls by a force of the springs, and the front panel can be pressed against the front face of the drawer sidewalls. A drawback is the fact that the mounting of the furniture fitting to the front panels is relatively elaborate.

SUMMARY OF THE INVENTION

It is an object of the present invention to propose a drawer arrangement of the type mentioned in the introductory part, in which a secure fixing of the wall element to the drawer sidewall is guaranteed and the installation effort can be reduced.

According to the invention, the at least one furniture fitting, in a connected condition of the wall element with the drawer sidewall, bears at least partially against the bearing surface of the wall element, so that the wall element is held on the drawer sidewall by the locking of the furniture fitting with the locking device of the drawer sidewall.

In other words, a screwing of a furniture fitting or a fixing of the furniture fitting with the aid of dowels on the front panel can be omitted, because the furniture fitting, in a connected condition of the wall element, bears against a bearing surface of the wall element (preferably an outer side) facing away from the drawer sidewall. As a result, the wall element is held, preferably exclusively, in position due to the locking of the furniture fitting with the drawer sidewall.

Thereby, the furniture fitting, at least partially, laterally embraces the wall element. Alternatively, the wall element includes at least one recess for receiving the furniture fitting, and the furniture fitting, in a mounted condition, bears at least partially against a peripheral region of the recess and protrudes through the recess of the wall element.

With a constructive simple embodiment, the bearing surface of the wall element is spaced from the fastening surface of the wall element by a material thickness of the wall element.

According to an embodiment, the drawer arrangement includes at least one cover element for covering the wall element, and the at least one cover element is configured to be releasably connected to the wall element. This can be implemented, for example, by at least one snap-connection device such that the cover element, in the connected condition with the wall element, is held by a material elasticity of the cover element.

According to a preferred embodiment, the wall element is a front panel of the drawer or a portion of a front panel of the drawer.

The method for connecting a wall element to a drawer sidewall of a drawer arrangement of the described type is characterized by the following steps:

- providing the furniture fitting separate from the wall element,
- connecting the furniture fitting to the wall element, wherein the furniture fitting, in the connected condition with the wall element, is at least partially supported on the bearing surface of the wall element,
- connecting the furniture fitting to the locking device of the drawer sidewall, the fastening surface of the wall element, in the connected condition with the drawer sidewall, facing towards the drawer sidewall.

BRIEF DESCRIPTION OF THE DRAWINGS

Further details and advantages of the present invention will be explained with the aid of the following description of figures, in which.

DETAILED DESCRIPTION OF THE INVENTION

Figure 1:
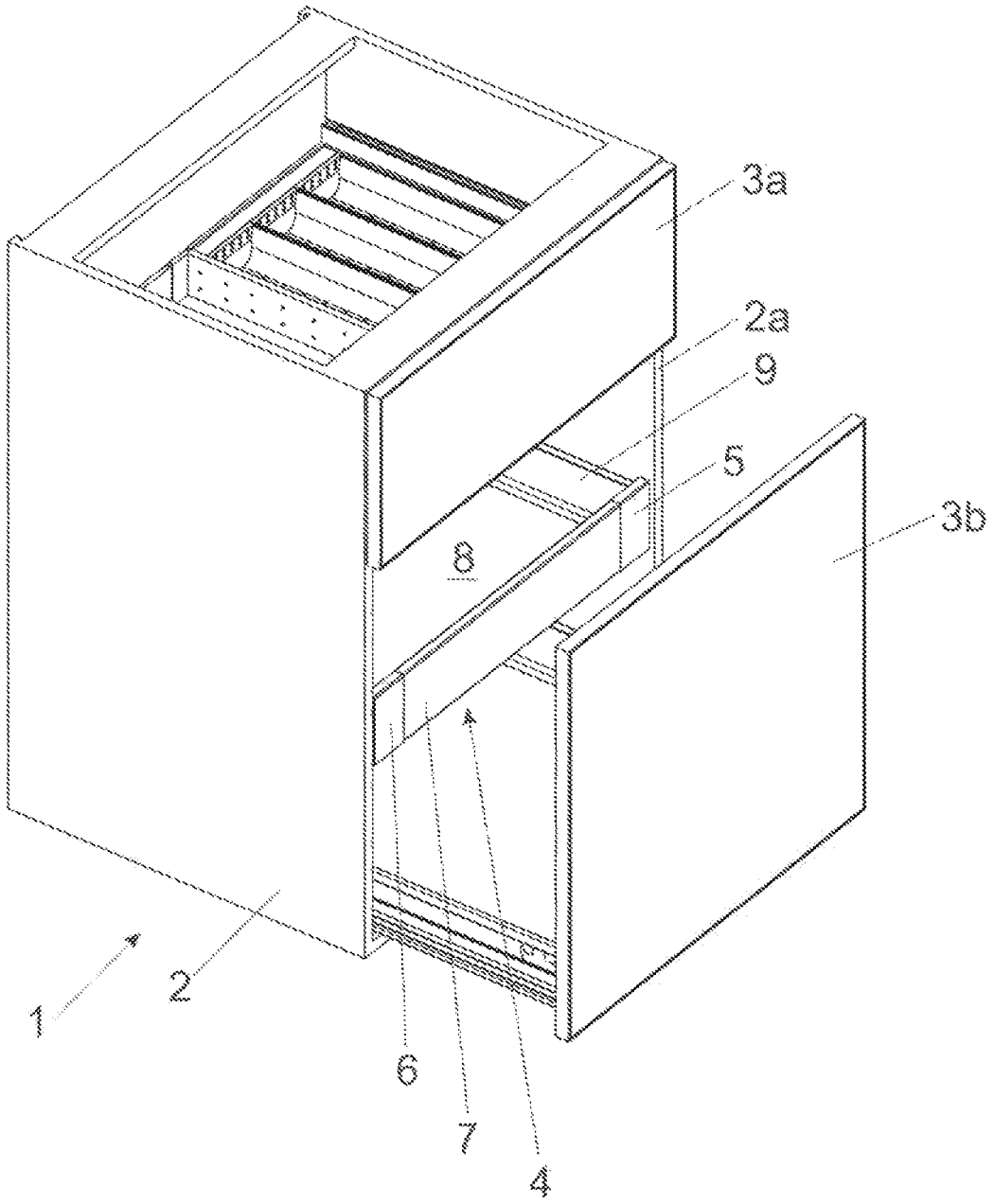
FIG. 1 is a perspective view of an item of furniture with drawers which are displaceably supported relative to a furniture carcass.

FIG. 1 shows a perspective view of a cupboard-shaped item of furniture 1 with a furniture carcass 2, in which drawers 3*a*, 3*b*, 4 are displaceably supported relative to the furniture carcass 2 by drawer pull-out guides (not shown). The front panels of the two drawers 3*a*, 3*b*, in the closed position of the drawers 3*a*, 3*b*, bear against a front face 2*a* of the furniture carcass 2. On the contrary, the drawer 4 can be configured as a so-called inner extension guide, in which the front drawer wall 11 (formed by the two wall elements 5, 6 and a wall profile 7 connecting the wall elements 5, 6) does not abut against the front face 2*a*, but is rather arranged between the two sidewalls of the furniture carcass 2. The drawer 4 includes a drawer bottom 8 and drawer sidewalls 9, 10, and the drawer 4, in the closed position, can be covered by a large front panel of the lower drawer 3*b*.

Figure 2:
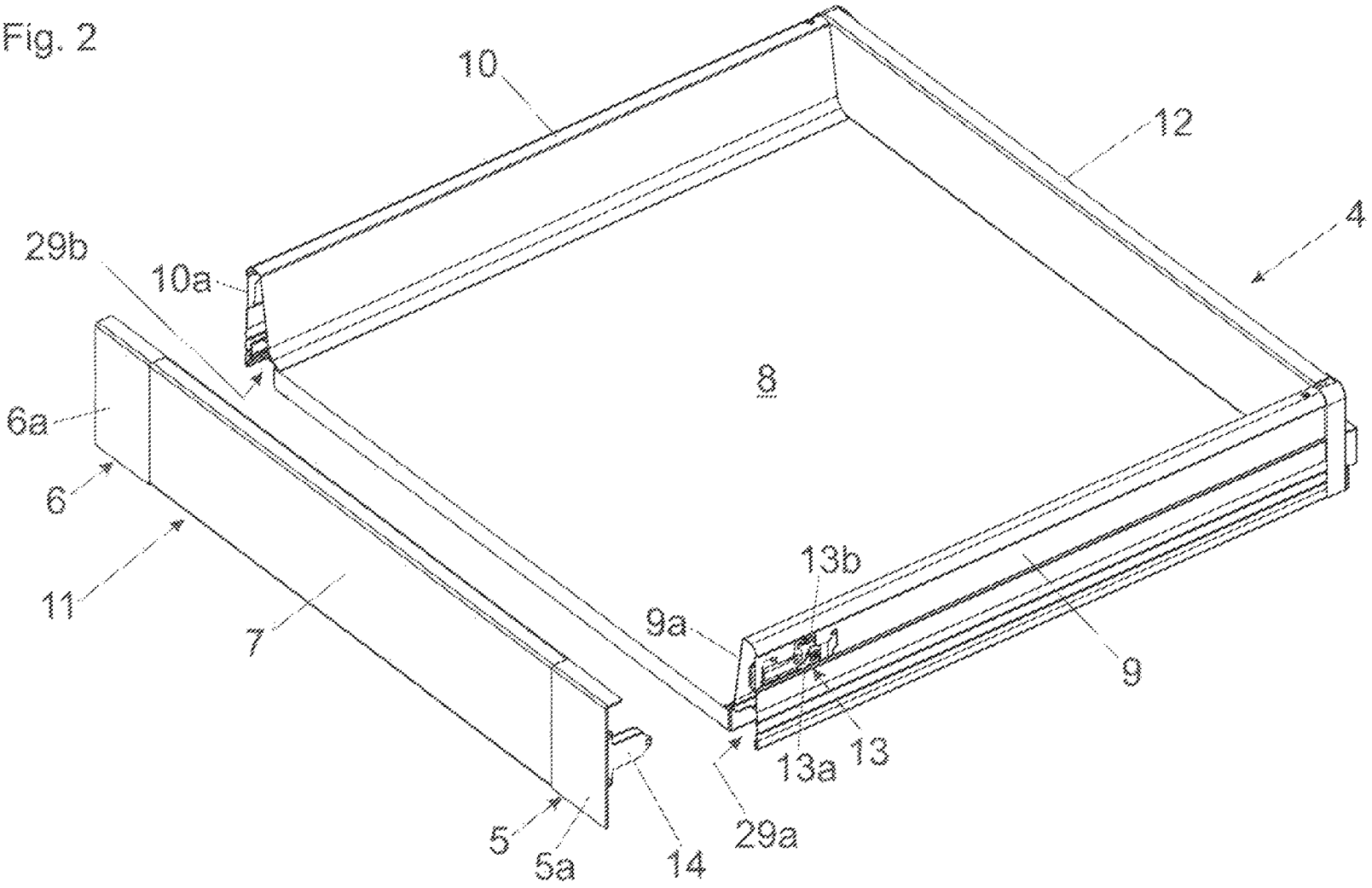
FIG. 2 shows a drawer in a perspective view.

FIG. 2 shows a perspective view of the drawer 4, the drawer 4 including a first drawer sidewall 9, a second drawer sidewall 10, a drawer bottom 8 and a rear wall 12. Each of the drawer sidewalls 9, 10 are configured as hollow-chamber profiles, in which—as commonly known—a locking device 13 for releasably locking the drawer wall 11 is arranged. The locking device 13 includes a locking lever 13*a* pre-stressed by at least one spring 13*b*, and the locking lever 13*a* is configured to be releasably locked to a furniture fitting 14 of the drawer wall 11. In order for the drawer wall 11 to be mounted, the furniture fittings 14 are each introduced into the front end region of the drawer sidewalls 9, 10, whereby the locking lever 13*a* of the locking device 13 can be released and the drawer wall 11 is pulled against the front faces 9*a*, 10*a* of the drawer sidewalls 9, 10 by a force of the springs 13*b*. Such locking devices are widely known according to the prior art (for example from the EP 0 740 917 B1 mentioned in the introductory part) and need not to be further described in greater detail here. Each of the wall elements 5, 6 can be covered by a cover element 5*a*, 5*b* (for example made of plastic or metal). Each of the drawer sidewalls 9, 10 includes a receiving space 29*a*, 29*b* for receiving a drawer pull-out guide, so that each of the drawer sidewalls 9, 10 are configured to be connected to an extendable guide rail of the drawer pull-out guide.

Figure 3A:
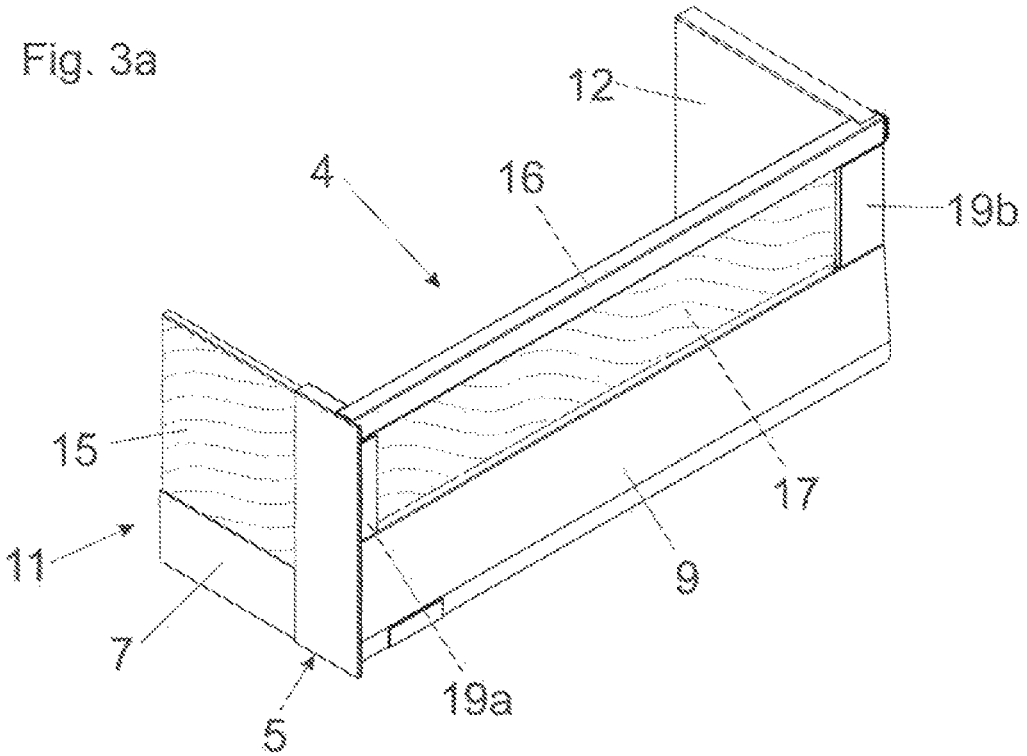
FIG. 3*a*, 3*b* show the drawer in a slightly modified embodiment, and the front drawer wall in an exploded view.

FIG. 3*a* shows a perspective partial view of a drawer 4 in a slightly modified embodiment. The front drawer wall 11 includes the first wall element 5 and the second wall element 6, the first wall element 5 and the second wall element 6 being configured so as to project above the intermediate wall profile 7 and forming, together with the intermediate wall profile 7, a frame for receiving a decorative plate 15. In a mounted condition, the decorative plate 15 is at least partially received within the frame. The drawer sidewall 9 further includes a front holding device 19*a* and a rear holding device 19*b*, and a plate-shaped insert 17 is accommodated between the front holding device 19*a* and the rear holding device 19*b*. The decorative plate 15 and/or the plate-shaped insert 17 can be formed of glass, wood, plastic, metal, ceramic and/or stone or can have a textile layer at least over a region. Above the plate-shaped insert 17, a railing strut 16 is arranged, the railing strut 16 extending between the front drawer wall 11 and the rear wall 12.

Figure 3B:
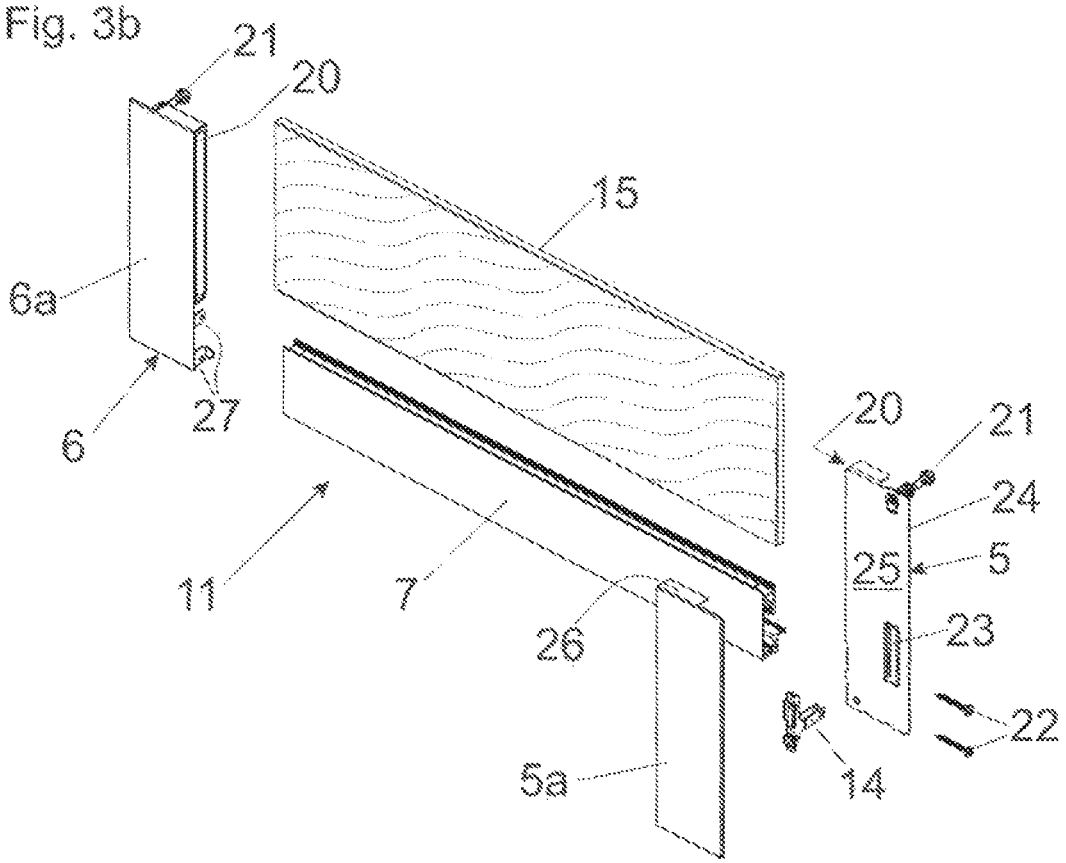

FIG. 3*b* shows the drawer wall 11 in an exploded view. Each of the first wall element 5 and the second wall element 6 projects above the wall profile 7 and includes at least one holder 20 for receiving an end portion of the decorative plate 15. In the shown embodiment, the holders 20 are configured as insertion openings configured to embrace, preferably entirely, a peripheral surface of an end portion of the decorative plate 15 in a mounted condition of the decorative plate 15. The wall elements 5, 6 are configured so as to be mirror-symmetrical to one another, so that the explanations provided here also apply to both wall elements 5, 6. Each of the wall elements 5, 6 includes transversely protruding tabs 27 with bores for allowing the passage of screws 22 by which the wall elements 5, 6 can be screwed to the wall profile 7. The wall elements 5, 6 have a fastening surface 24 facing towards the drawer sidewall 9, 10, and a bearing surface 25 facing away from the fastening surface 24. The furniture fitting 14, in the connected condition of the wall element 5, 6 with the drawer sidewalls 9, 10, at least partially bears against the bearing surface 25 of the wall element 5, 6, so that the wall element 5, 6 is held on the drawer sidewall 9, 10 by the locking of the furniture fitting 14 with the locking device 13 of the drawer sidewall 9, 10. In the shown embodiment, each of the wall elements 5, 6 includes a recess 23 for receiving the furniture fitting 14, and the furniture fitting 14, in a mounted condition, bears at least partially, for example also loosely, against a peripheral region 23*a* (FIG. 4*a*) of the recess 23 and projects through the recess 23 of the wall elements 5, 6. In that way, the wall element 5, 6 is pulled against the front face 10*a*, 10*b* of the drawer sidewall 9, 10 due to the locking of the furniture fitting 14 with the locking device 13 of the drawer sidewall 9, 10 and is thereby fixed relative to the drawer sidewall 9, 10. By a connecting pin 21 arranged on the wall element 5, the front end portion of the railing strut 16 can be fixed.

Figure 4C:
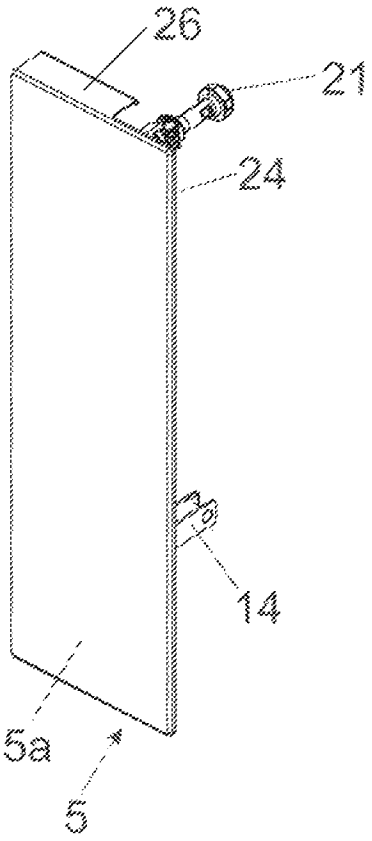
FIG. 4*a*-4*c* show the wall element with the furniture fitting and the cover in different perspective views.
Figure 4B:
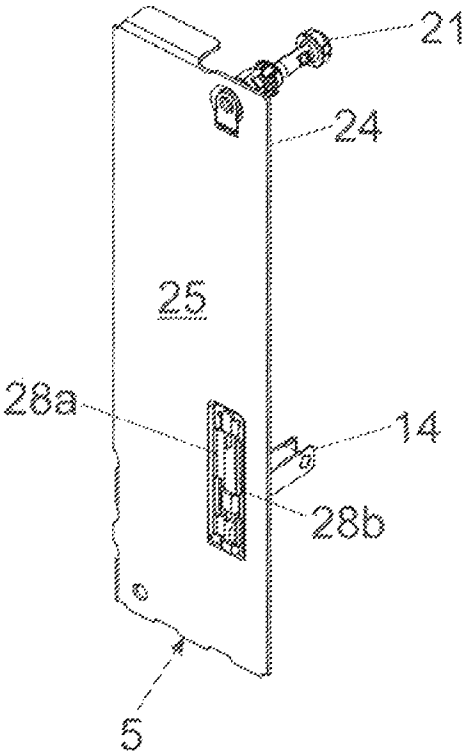
Figure 4A:
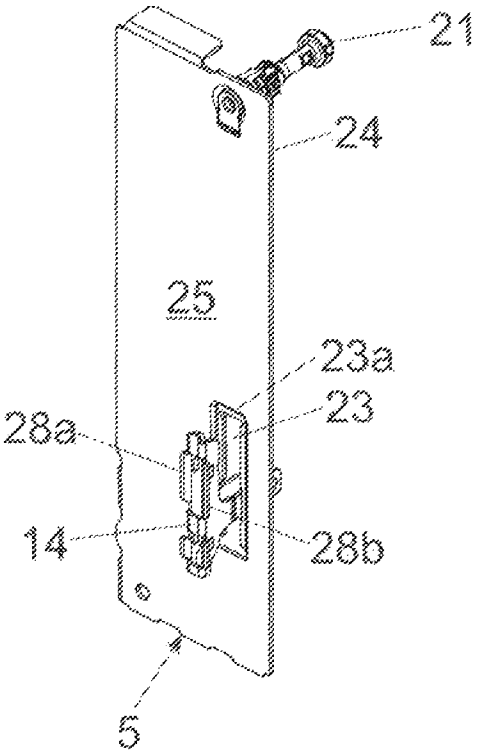

FIG. 4*a* shows the wall element 5 with the bearing surface 25 facing away from the drawer sidewall 9, and the furniture fitting 14 bears against the bearing surface 25 in the connected condition. The wall element 5 includes a recess 23 having a peripheral region 23*a*, and the furniture fitting 14 bears at least partially against the peripheral region 23*a*. The furniture fitting 14 can include at least one laterally projecting wing 28*a*, 28*b* which is supported on the peripheral region 23*a* of the recess 23 in the connected condition. The furniture fitting 14 can be additionally secured to the wall element 5 by a locking device in order for an unintentional release between the furniture fitting 14 and the wall element 5 to be prevented. The at least one furniture fitting 14 can be at least partially guided, starting from the bearing surface 25 of the wall element 5, through the at least one recess 23 of the wall element 5.

FIG. 4*b* shows the furniture fitting 14 introduced into the wall element 5, and the wings 28*a*, 28*b* are supported on the bearing surface 25 of the wall element 5. The peripheral region 23*a* of the recess 23 can be configured as a depression in the form of an embossment, so that the wings 28*a*, 28*b* of the furniture fitting 14 are aligned substantially flush with the bearing surface 25 of the wall element 5. By a cover element 5*a* (FIG. 4*c*) configured to be releasably fixed to the wall element 5 by at least one snap-connection device 26, the recess 23 of the wall element 5 can be covered. The at least one wing 28*a*, 28*b* of the furniture fitting 14, in the connected condition of the furniture fitting 14, can be configured so as to extend substantially parallel to the bearing surface 25 of the wall element 5, whereby a very compact construction can be obtained and the furniture fitting 14 can be simply covered by a planar-shaped cover element 5*a*.

Figure 5A:
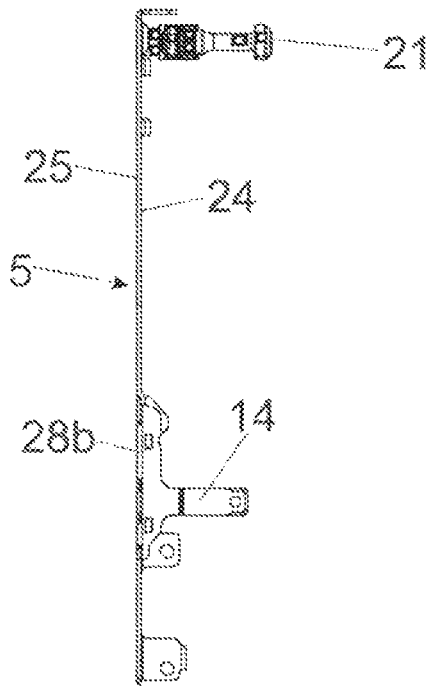
FIG. 5*a*-5*c* show the wall element with the furniture fitting in a cross-sectional view, and two further possible embodiments of drawers in schematic views from the top.

FIG. 5*a* shows a cross-sectional view of the wall element 5 with the furniture fitting 14 bearing thereon. The wall element 5 has a fastening surface 24 facing towards the drawer sidewall 9, 10 in a mounted position, and a bearing surface 25 facing away from the fastening surface 24. The furniture fitting 14, preferably with the at least one wing 28*b*, bears against the bearing surface 25 of the wall element 5. It is visible that the bearing surface 25 of the wall element 5 and the wing 28*b* of the furniture fitting 14 are aligned flush to one another, so that no disturbing abutting edge is formed between the bearing surface 25 and the furniture fitting 14.

Figure 5B:
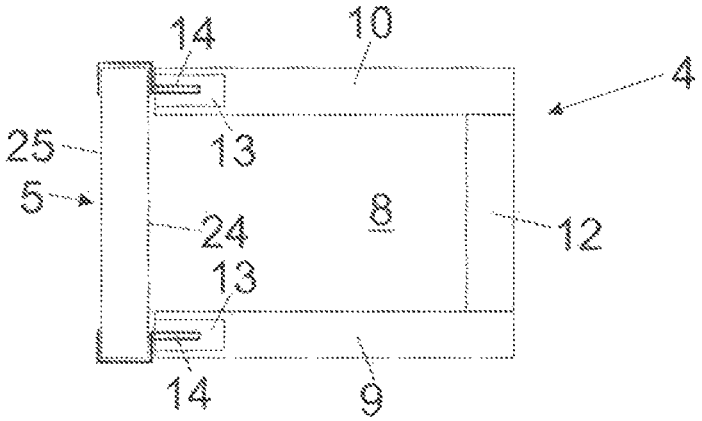

FIG. 5*b* shows a schematically depicted drawer 4 with the wall element 5, the drawer sidewalls 9, 10 and the rear wall 12 in a top view. In the embodiment shown in FIG. 5*b*, the furniture fitting 14 embraces an end portion of the wall element 5, and the bearing surface 25 of the wall element 5 is formed by a front visible surface of the wall element 5. In the shown embodiment, the bearing surface 25 of the wall element 5 is spaced from the fastening surface 24 of the wall element 5 by a material thickness of the wall element 5. Each of the furniture fittings 14 are configured to be releasably locked to the locking device 13 of the drawer sidewalls 9, 10.

Figure 5C:
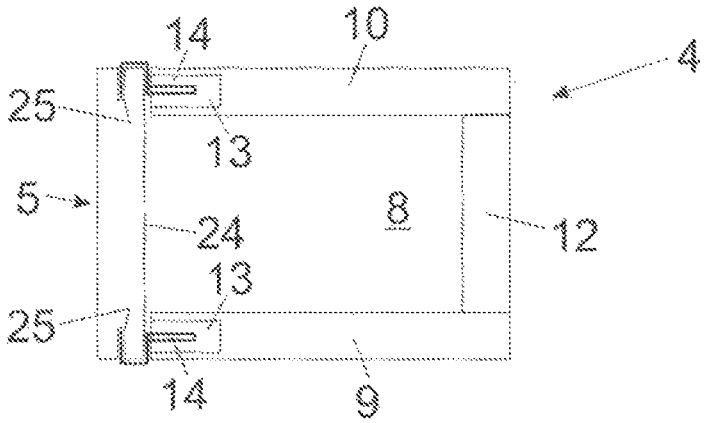

FIG. 5*c* shows a further embodiment, in which the furniture fitting 14 engages into a lateral recess of the wall element 5, and the bearing surface 25 of the wall element 5 is formed by an inner side of the recess of the wall element 5.

With all embodiments, it can be provided that the bearing surface 25 of the wall element 5, in the connected condition with the drawer sidewall 9, 10, is spaced from the fastening surface 24 of the wall element 5 in a direction of a longitudinal extension of the drawer sidewall 9, 10.

The invention claimed is:

1. A drawer arrangement, comprising: a drawer sidewall having a locking device, the locking device of the drawer sidewall including a locking lever pre-stressed by at least one spring; a wall element to be transversely connected to the drawer sidewall, wherein the wall element, in a connected condition with the drawer sidewall, includes a fastening surface facing towards the drawer sidewall, and a bearing surface facing away from the fastening surface; and at least one furniture fitting separate from the wall element for connecting the wall element to the drawer sidewall, wherein the at least one furniture fitting is configured to be releasably locked to the locking lever of the locking device of the drawer sidewall, wherein the at least one furniture fitting, in a connected condition of the wall element with the drawer sidewall, bears at least partially against the bearing surface of the wall element, so that the wall element is held on the drawer sidewall by the locking of the furniture fitting with the locking device of the drawer sidewall, wherein the wall element includes at least one recess configured to receive the furniture fitting, the at least one recess having a peripheral region, and wherein the peripheral region of the at least one recess is set back relative to the bearing surface an embossment extending from the fastening surface in a direction toward the drawer sidewall.

2. The drawer arrangement according to claim 1, wherein the bearing surface of the wall element, in the connected condition with the drawer sidewall, is spaced from the fastening surface of the wall element in a direction of a longitudinal extension of the drawer sidewall.

3. The drawer arrangement according to claim 1, wherein the drawer sidewall has a front face, the fastening surface of the wall element bearing at least partially against the front face of the drawer sidewall in the connected condition of the wall element with the drawer sidewall.

4. The drawer arrangement according to claim 1, wherein the furniture fitting, in the connected condition of the wall element with the drawer sidewall, loosely bears against the bearing surface of the wall element.

5. The drawer arrangement according to claim 1, wherein the furniture fitting includes at least one laterally projecting wing which, in the connected condition of the wall element with the drawer sidewall, bears against the bearing surface of the wall element.

6. The drawer arrangement according to claim 1, wherein the furniture fitting, in the connected condition with the wall element, at least partially bears against the peripheral region of the at least one recess and projects through the at least one recess of the wall element.

7. The drawer arrangement according to claim 6, wherein the at least one furniture fitting, starting from the bearing surface of the wall element, can be at least partially guided through the at least one recess of the wall element.

8. The drawer arrangement according to claim 1, wherein the drawer arrangement includes at least one cover element for covering the wall element, wherein the at least one cover element is configured to be releasably connected to the wall element.

9. The drawer arrangement according to claim 8, wherein the at least one cover element is configured to be fixed to the wall element by at least one snap-connection device.

10. The drawer arrangement according to claim 1, wherein the drawer sidewall includes a receiving chamber for receiving a drawer pull-out guide.

11. The drawer arrangement according to claim 1, wherein the wall element is a front panel of the drawer or a portion of a front panel of the drawer.

12. The drawer arrangement according to claim 1, wherein the bearing surface, which faces away from the fastening surface, is arranged opposite the fastening surface.

13. The drawer arrangement according to claim 1, wherein the drawer sidewall is a first drawer sidewall, and wherein the drawer arrangement further comprises a drawer wall which includes the wall element as a first wall element.

14. The drawer arrangement according to claim 13, wherein the drawer wall includes at least one second wall element, wherein the at least one furniture fitting includes a first furniture fitting and a second furniture fitting, and wherein the first wall element is to be connected to the first drawer sidewall by the first furniture fitting, and the at least one second wall element is to be connected to a second drawer sidewall by the second furniture fitting.

15. The drawer arrangement according to claim 14, wherein the first wall element and the at least one second wall element are connected to one another by at least one wall profile, wherein the first wall element and the at least one second wall element, together with the at least one wall profile, jointly form a frame for receiving a decorative plate, and the decorative plate, in a mounted condition, is at least partially received within the frame.

16. The drawer arrangement according to claim 15, wherein each of the first wall element and the at least one second wall element projects above the at least one wall profile and includes at least one holder for receiving a respective end portion of the decorative plate.

17. The drawer arrangement according to claim 16, wherein the decorative plate is formed of glass, wood, plastic, metal, ceramic or stone, or that the decorative plate has a textile layer at least over a region.

18. A drawer comprising at least one drawer arrangement according to claim 13.

19. A method for connecting a wall element to a drawer sidewall of a drawer arrangement according to claim 1, comprising:

providing the at least one furniture fitting separate from the wall element;

connecting the at least one furniture fitting to the wall element, wherein the at least one furniture fitting, in the connected condition with the wall element, is supported at least partially on the bearing surface of the wall element; and connecting the at least one furniture fitting to the locking device of the drawer sidewall, the fastening surface of the wall element, in the connected condition with the drawer sidewall, facing towards the drawer sidewall.

20. The method according to claim 19, wherein the at least one furniture fitting, in the course of connecting the at least one furniture fitting to the wall element, is pushed, starting from the bearing surface of the wall element, through at least one recess of the wall element.

21. The drawer arrangement according to claim 5, wherein the at least one wing, in the connected condition of the furniture fitting with the wall element, extends substantially parallel to the bearing surface of the wall element.

22. The drawer arrangement according to claim 1, wherein the wall element includes a connecting pin configured to be fixed to a railing strut of a drawer.

23. A drawer arrangement, comprising: a drawer sidewall having a locking device, the locking device of the drawer sidewall including a locking lever pre-stressed by at least one spring; a wall element to be transversely connected to the drawer sidewall, wherein the wall element, in a connected condition with the drawer sidewall, includes a fastening surface facing towards the drawer sidewall, and a bearing surface facing away from the fastening surface; and at least one furniture fitting separate from the wall element for connecting the wall element to the drawer sidewall, wherein the at least one furniture fitting is configured to be releasably locked to the locking lever of the locking device of the drawer sidewall, wherein the at least one furniture fitting, in a connected condition of the wall element with the drawer sidewall, bears at least partially against the bearing surface of the wall element, so that the wall element is held on the drawer sidewall by the locking of the furniture fitting with the locking device of the drawer sidewall, wherein the wall element includes at least one recess configured to receive the furniture fitting, the at least one recess is an embossment extending from the fastening surface in a direction toward the drawer sidewall, the furniture fitting includes at least one laterally projecting wing which, in the connected condition, is arranged in a same plane with the bearing surface of the wall element.

24. The drawer arrangement according to claim 23, wherein the drawer arrangement includes at least one cover element for covering the wall element such that in a connected condition, the at least one cover element and the wall element bear flatly against one another with no gap therebetween.

25. A drawer arrangement, comprising: a drawer sidewall having a locking device, the locking device of the drawer sidewall including a locking lever pre-stressed by at least one spring; a wall element to be transversely connected to the drawer sidewall, wherein the wall element, in a connected condition with the drawer sidewall, includes a fastening surface facing towards the drawer sidewall, and a bearing surface facing away from the fastening surface; and at least one furniture fitting separate from the wall element for connecting the wall element to the drawer sidewall, wherein the at least one furniture fitting is configured to be releasably locked to the locking lever of the locking device of the drawer sidewall, wherein the at least one furniture fitting, in a connected condition of the wall element with the drawer sidewall, bears at least partially against the bearing surface of the wall element, so that the wall element is held on the drawer sidewall by the locking of the furniture fitting with the locking device of the drawer sidewall, and wherein the furniture fitting includes at least one laterally projecting wing, the wall element includes at least one recess configured to receive the furniture fitting, the at least one recess is an embossment extending from the fastening surface in a direction toward the drawer sidewall, and a material thickness of the at least one laterally projecting wing corresponds to a depth of the at least one recess of the wall element.

* * * * *